United States Patent [19]

Prager

[11] 4,272,922

[45] Jun. 16, 1981

[54] WINDOW GUARD SUPPORT

[76] Inventor: Irwin D. Prager, 34 Malone Ave., Staten Island, N.Y. 10306

[21] Appl. No.: 52,005

[22] Filed: Jun. 25, 1979

[51] Int. Cl.[3] ..... E06B 3/68

[52] U.S. Cl. ..... 49/55; 49/465

[58] Field of Search ..... 49/55, 465, 57; 160/327, 404, 126, DIG. 9; 248/217.2, 226.1, 226.4

[56] References Cited

U.S. PATENT DOCUMENTS

| | | | |
|---|---|---|---|
| 1,025,064 | 4/1912 | Huffman | 160/404 X |
| 1,206,489 | 11/1916 | Weiss | 160/126 X |
| 2,275,236 | 3/1942 | Shannon | 160/DIG. 9 |
| 2,583,613 | 1/1952 | Talbott | 49/55 X |

*Primary Examiner*—Kenneth Downey

*Attorney, Agent, or Firm*—Eugene E. Geoffrey, Jr.

[57] ABSTRACT

A support for holding a guard in overlying relationship to a window which includes a pair of spaced bracket members carrying an elongated bar having guard engaging pins, window engaging locking arms adjoining said brackets and supported for movement along an axis parallel to the elongated bar, each locking arm having window frame engaging pins which when engaging the window frame will hold the support in position. At least two supports are used on each window and may be vertically or horizontally disposed to hold the guard.

9 Claims, 8 Drawing Figures

10
10'
11
12
13
14
15
16
17
18
19
20
21
22
23
25
25'
27
28
31
32
34
8

10
11
13
14
15
16
17
18
19
20
25
25'
26
27
28
31
32
34
A
B

WINDOW GUARD SUPPORT

This invention relates to supports for window guards and more specifically to novel and improved supporting means readily attachable to a window frame to firmly hold a window guard such as wire mesh, screening, expanded metal and the like in overlying relationship to the window for protection of the glass.

In the construction of buildings and more specifically apartment houses and similar structures, windows are usually installed on the lower floors as construction proceeds on the upper floors with a result that the window glass is frequently broken and replacement is time consuming and costly. Moreover, considerable damage has also been experienced because of vandalism since many structures in the course of fabrication are unprotected. Window damage is also experienced during the renovation of buildings.

Known procedures for the protection of windows are relatively complicated and expensive. Very often, wire screening, plyboard or the like is merely nailed to the window frame with the result that the frames are damaged and marred and removal of the mesh or plyboard often causes further damage to the frame.

This invention avoids the difficulties heretofore experienced in the protection of windows during construction, renovation and the like and provides a novel and improved support for window guards that can be readily adjusted to fit a plurality of window sizes and can be readily and quickly installed either from within the building or from without. Moreover, the support in accordance with the invention will cause little if any material damage to the window frame and at the same time it provides secure means for maintaining a guard in position over the window.

Another object of the invention resides in a novel and improved window guard support which is quickly and easily affixed to a window frame and will accommodate a wide variety of window sizes.

Still another object of the invention resides in a novel and improved support for window guards which is characterized by its simplicity, ease of installation and relatively low cost.

The window guard support in accordance with one form of the invention includes a pair of end brackets carrying an elongated angle member having guard engaging pins extending therefrom. An elongated shaft having threaded end portions extends between and is rotatably supported by said brackets and a pair of locking arms threadably engage the ends of the shaft and have window frame engaging means. Rotation of the shaft functions to move the locking arms into and out of engagement with the window frame. Two supports disposed horizontally or vertically may be used to support a guard on each window.

The above and other objects and advantages of the invention will become more apparent from the following description and accompanying drawings forming part of this application.

Figures 1, 8:
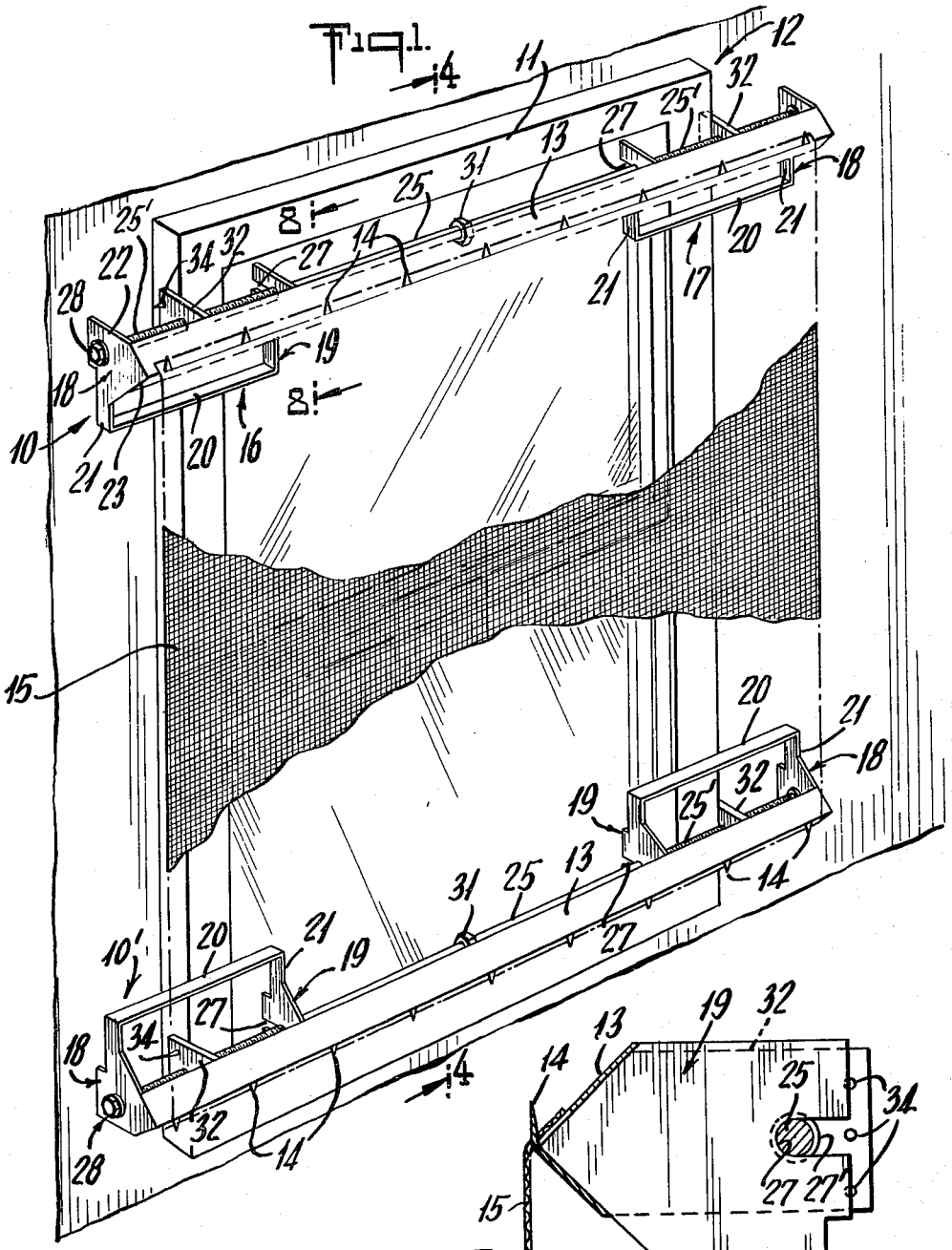
FIG. 1 is a perspective view of a window and window guard affixed in overlying relationship thereto utilizing a novel and improved support in accordance with the invention.

Referring now to the drawings and more specifically to FIG. 1, the numerals 10 and 10′ denote window guard supports in accordance with the invention with the support 10 affixed to the upper portion of the frame 11 of the window 12 while the support 10′ is fixed to the lower portion of the window frame 11. Each of the supports carry elongated members 13 of angle iron, aluminum or the like, each having a plurality of pointed projections or hooks 14 with the projections on the upper support 10 being directed upwardly while the projections on the lower support 10′ being projected downwardly. A window guard 15 such as wire mesh, expanded sheet metal or other suitable material is placed in engagement with the upper and lower projections 14 and thereby held in place over the window. As will be pointed out, the upper support 10 would normally be fixed in position and the guard 15 then hooked to the projections 14. The second guard 10′ would then be placed approximately in position with the guard engaging the downwardly extending hooks 14. The support 10′ would then be pressed downwardly to place the guard 15 under tension whereupon it would then be secured in position as illustrated in FIG. 1.

In as much as the supports 10 and 10′ are identical, only the support 10 will be described in detail. Each support comprises a pair of spaced brackets 16 and 17, each having a pair of spaced parallel plates 18 and 19 coupled by a stabilizing member 20. Each of the plates 18 and 19 has a narrow portion 21 adjoining the stabilizing member 20 and an upper portion 22 having a triangularly shaped front edge portion 23 to which the elongated member 13 is secured by welding or other suitable means. In this way, the brackets 16 and 17 are fixed in position by the elongated member 13 to form a rigid structure. The members 18 and 19 have a rectangular portion 24 extending rearwardly thereof to provide adequate material to permit the formation of a hole for the purpose of recieving an elongated shaft 25 which will now be described.

Figure 5:
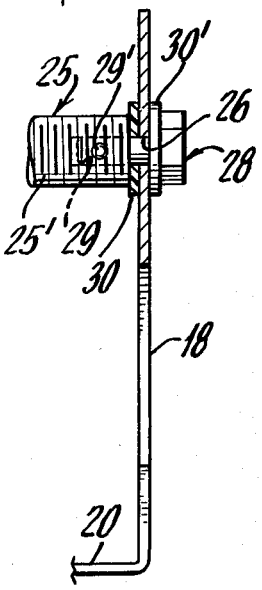
FIG. 5 is a fragmentary cross sectional view of an end portion of the upper support shown in FIG. 1 and taken along the line 5—5 of FIG. 3.
Figure 6:
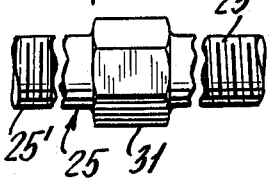
FIG. 6 is a fragmentary view of the central portion of the transverse rod as illustrated in FIGS. 1, 2 and 3.
Figure 7:
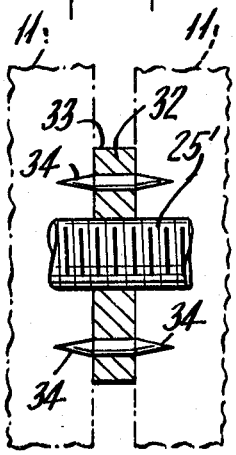
FIG. 7 is a cross sectional view of FIG. 4 taken along the line 7—7 thereof; and, FIG. 8 is a cross sectional view of FIG. 1 taken along the line 8—8 thereof.

The plates 18 of the brackets 16 and 17 have aligned openings 26 for rotatably receiving the shanks of bolts 28 which are threadably received in openings 29 in the ends of the shaft 25 as illustrated for instance in FIG. 5. The bolts are secured in position by pins 29′ so that the shaft can be rotated by utilizing suitable wrench in engagement with a hexagonal head of one of the bolts 28. The shaft also has a central hexagonal element 31 which may also be utilized for rotation of the shaft. To facilitate assembly of the support the plates 19 of the brackets 16 and 17 are provided with slots 27 as shown more clearly in FIG. 8 and if desired the shaft 25 may be grooved as denoted by the numeral 27′ so that the inner portion of each plate 19 will be held in position relative to the cooperating plate 18. This arrangement facilitates convenient installation of the shaft 25 after the elongated member 13 is welded or otherwise secured to the brackets 16 and 17. In the installation of the shaft 25, washers 30 and 30' may be positioned on the inner and outer sides of the plates 18 to provide relatively smooth bearing surfaces for rotation of the shaft 25.

Figures 2, 3:
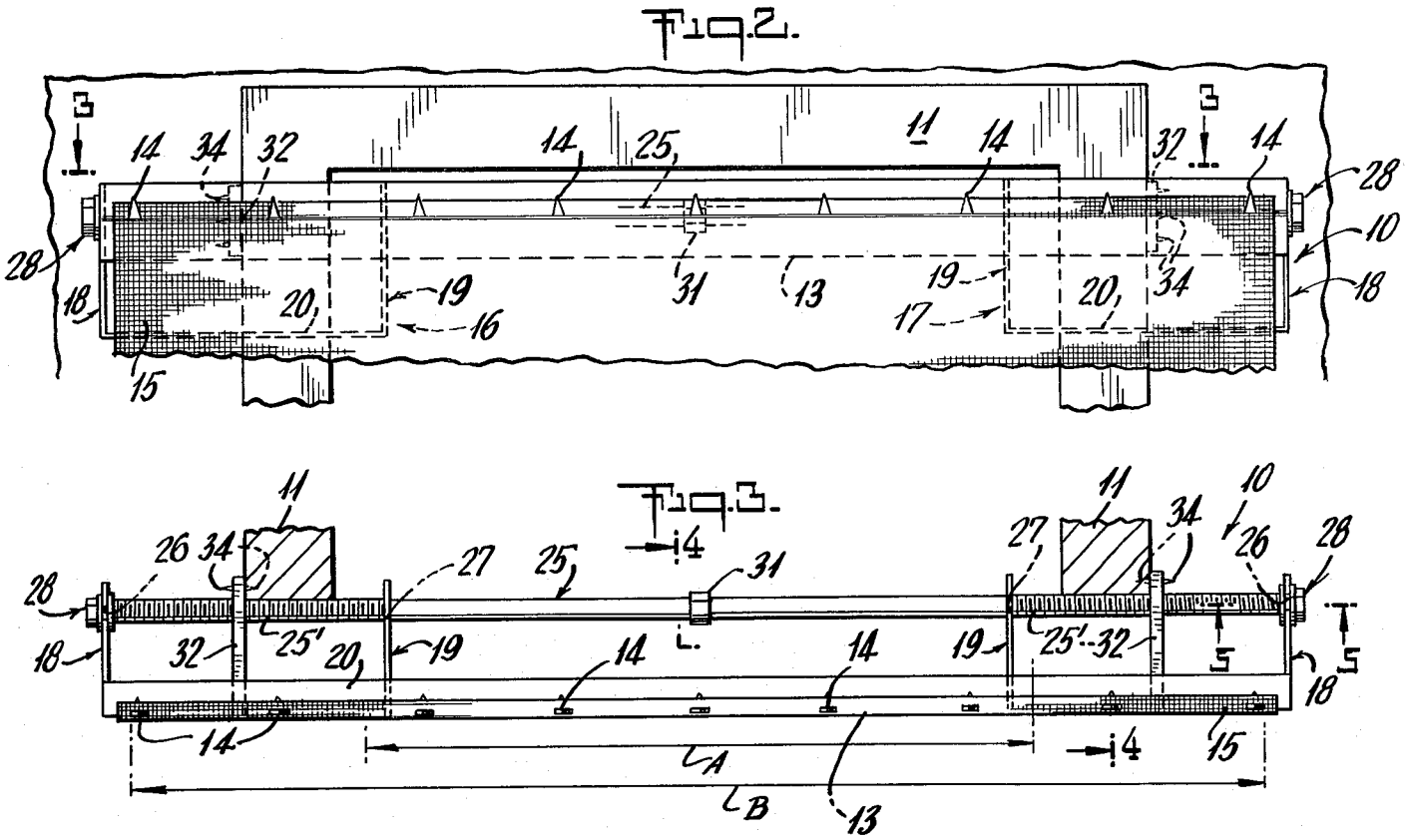
FIG. 2 is a front elevational view of the upper guard support of FIG. 1.
FIG. 3 is plan view of the support shown in FIG. 2 and taken in the direction of the line 3—3 thereof.
Figure 4:
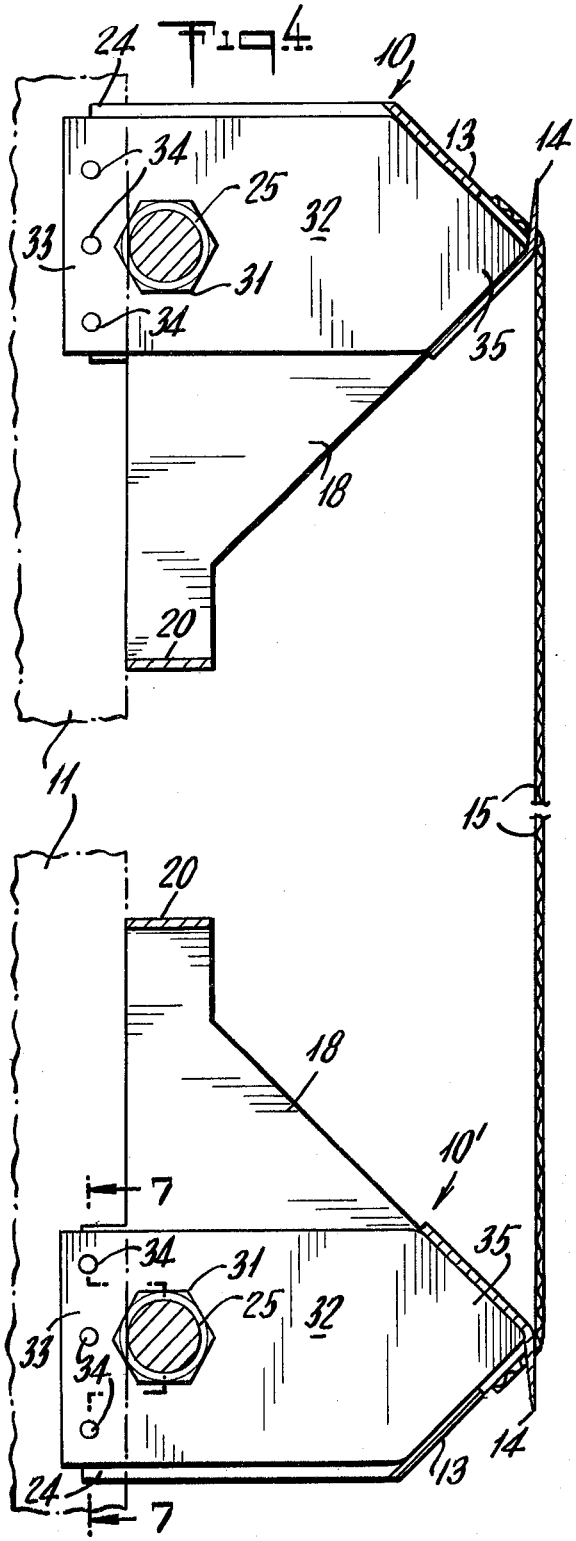
FIG. 4 is a cross sectional view of FIG. 1 taken along the line 4—4 thereof.

The ends 25' of the shaft 25 each carry a locking arm 32 as will be observed more clearly in FIGS. 1, 3 and 4. The inner end 33 of each locking arm extends slightly beyond the rectangular portion 24 of the bracket members 18 and 19 and carry a plurality of pointed pins or tines 34 extending from each face thereof as will be observed more clearly in FIG. 3. The forward end portion 35 of the locking arm 32 is of triangular configuration and slidably engages the angularly formed member 13. With this arrangement, the locking arms are always maintained in a selected orientation with reference to the bracket members 16 and 17 and, since the ends 25' of the shaft 25 have left and right hand threads respectively, when the shaft 25 is rotated the arms 32 will be simultaneously moved inwardly or outwardly depending on the rotation of the shaft.

Moreover, in as much as the locking arms carry pins or tines 34 on each face thereof, the locking arms can be moved to engage either the outer surface of the window frame 11 or the inner surface whichever may be more convenient.

To install a support in accordance with the invention, the shaft 25, as in the case of FIG. 1, would be rotated to move the locking arms 32 outwardly beyond the outer edges of the window frame 11. The structure would then be held firmly in position and the shaft 25 rotated in the opposite direction to move the locking arms 32 toward the window frame. If the installation is performed from the inside, rotation of the shaft 25 would be accomplished by utilizing a suitable wrench for engagement with the hexagonal portion 31 disposed centrally of the shaft. If the installation is accomplished from the outside then rotation of the shaft would be accomplished by engaging the hexagonal head of one or the other of the bolts 28. Should the window frame be of such character as to require the locking arms to engage the inner surfaces thereof, then of course the locking arms would be moved inwardly to completely clear the inner surfaces of the frame through the rotation of the shaft 25. Then when the support is in the proper position, the shaft 25 would be rotated in the opposite direction to move the locking arms outwardly and cause the outwardly extending pins to engage the inner surfaces of the window frame.

When fixing the supports 10 and 10' to a window, the upper support 10 would first be placed in position and secured in the manner discussed above. Thereafter, the wire mesh or other material utilized to overly the window would be placed in engagement with the upwardly extending pins 14 as previously described. Thereafter, the lower support member 10' would be adjusted for engagement with either the outside or the inside of the window frame, as the case may be, whereupon it would be placed in engagement with the wire mesh 15 by hooking the mesh to the downwardly extending pins 14. The support would then be forced downwardly to tighten the screen 15 whereupon the shaft 25 would then be rotated to move the locking arms 32 into contact with the window frame and thus secure the support in position. In this way, the screen in held securely in overlying relationship to the window and thus provide complete protection therefor.

It is apparent from the foregoing description that the support in accordance with the invention can be made of relatively light weight material since the plates 18 and 19 of each bracket are held in parallel relationship by the shaft 25, the stabilizing bar 20 and the elongated angularly shaped bar 13 carrying the pins for engagement with the screen. It will also be observed that when the locking arms 32 are in position on a window frame that the stabilizing arms 20 prevent rotation of the support so that the pins 14 will maintain a substantially vertical position and thus retain the screen 15 in secure engagement therewith. After the requirement for window protection is no longer necessary, the supports can be quickly and easily removed either from the inside or the outside and if need be the small openings in the window frame that may have been produced by the pins 34 on the locking arm can be readily filled with a suitable filler material.

While only one embodiment of the invention has been illustrated and described, it is understood that alterations, changes and modifications may be made without departing from the true scope and spirit thereof.

What is claimed is:

1. Window guard supporting means for securing a window guard such as steel mesh, screening and the like in overlying relationship to a window having a surrounding frame comprising at least one support for attachment to said window, said support comprising a pair of spaced brackets, an elongated member extending between and rotatably carried by said brackets, a carrier member extending between and secured to said brackets, said carrier member including means for engaging and supporting said guard, and adjustable means carried by and adjoining each end of said elongated member and movable into engagement with said frame to releasably secure said support to said window frame.

2. Window guard supporting means according to claim 1 wherein each of said brackets comprises a pair of spaced parallel plates, a stabilizing bar connecting said plates, and engaging said window frame when said support is secured in position, said plates having aligned openings therein for rotatably retaining said elongated member, said elongated member having threaded portions disposed at least between the parallel plates of each bracket and said adjustable means are carried by and engage said threaded portions.

3. Window guard supporting means according to claim 2 wherein said carrier member comprises two angularly disposed elongated strips of material joined one to the other and to the plates of each bracket and pins carried by said carrier member for engaging said guard.

4. Window guard supporting means according to claim 3 wherein each of said adjustable means comprises a locking arm disposed between and in parallel relationship to said bracket plates, one end of said locking arm slidably engaging said carrier member to prevent rotation thereof when said elongated member is rotated and the other end of said locking arm carries pins for engaging the window frame to lock the support in position.

5. Window guard supporting means according to claim 4 wherein said locking arm has window frame engaging means on opposing surfaces thereof.

6. Window guard supporting means according to claim 5 wherein the threaded portions on each end of said elongated member are in reverse directions whereby rotation of the last said member in one direction will move the locking arms outwardly and rotation in the other direction will move said locking arms inwardly.

7. Window guard supporting means according to claim 6 wherein said elongated member includes wrench engaging means disposed centrally thereof and on at least one end thereof.

8. Window guard supporting means according to claim 1 including at least two spaced supports for engaging two opposing edges of said guard.

9. Window guard supporting means for securing a window guard such as steel mesh, screening and the like in overlying relationship to a window having a surrounding frame comprising at least one support for attachment to said window, said support comprising a pair of spaced brackets, a carrier member extending between and secured to said brackets, said carrier member including means for engaging and supporting said guard, and a pair of window frame engaging means carried by and adjoining said brackets, at least one of said engaging means being movable relative to its associated bracket to effect engagement of both the last said means with said frame to releasably secure said support to said window frame.

* * * * *